US011988382B2

(12) United States Patent
Brueck

(10) Patent No.: US 11,988,382 B2
(45) Date of Patent: May 21, 2024

(54) ROTARY KILN FOR THE EVAPORATION OF THERMOPLASTIC WASTE

(71) Applicant: FUENIX ECOGY IP B.V., Weert (NL)

(72) Inventor: Gernot Klaus Brueck, Hoensbroek (NL)

(73) Assignee: FUENIX ECOGY IP B.V., Weert (NL)

( * ) Notice: Subject to any disclaimer, the term of this patent is extended or adjusted under 35 U.S.C. 154(b) by 498 days.

(21) Appl. No.: 17/442,513

(22) PCT Filed: Mar. 26, 2020

(86) PCT No.: PCT/NL2020/050209
§ 371 (c)(1),
(2) Date: Sep. 23, 2021

(87) PCT Pub. No.: WO2020/197395
PCT Pub. Date: Oct. 1, 2020

(65) Prior Publication Data

US 2022/0170634 A1 Jun. 2, 2022

(30) Foreign Application Priority Data

Mar. 26, 2019 (DE) ..... 10 2019 107 739.7
Jul. 11, 2019 (NL) ..... 2023475

(51) Int. Cl.
*F23G 7/12* (2006.01)
*F23G 5/027* (2006.01)

(52) U.S. Cl.
CPC ..... *F23G 7/12* (2013.01); *F23G 5/0273* (2013.01); *F23G 2201/30* (2013.01);
(Continued)

(58) Field of Classification Search
CPC ..... F23G 7/12; F23G 5/0273; F23G 2201/30; F23G 2203/20; F23G 2205/121; F23G 2205/124; F23G 2209/28
See application file for complete search history.

(56) References Cited

U.S. PATENT DOCUMENTS 3,752,333 A 8/1973 Yerouchalmi
4,340,359 A * 7/1982 Struckmann ..... F27D 7/02 432/17

(Continued)

FOREIGN PATENT DOCUMENTS

DE 102014109579 A1 1/2016
JP H09279161 A 10/1997
NL 2015089 A 4/2016

*Primary Examiner* — David J Laux
(74) *Attorney, Agent, or Firm* — BROWDY AND NEIMARK, PLLC

(57) ABSTRACT

This invention relates to a rotary kiln (1) for cracking open and evaporating size-reduced plastic waste, consisting of a cylindrical kiln housing (2) the wall of which can be heated to the respective evaporation temperature. The kiln housing (2) is bearing mounted so as to be rotatable around a longitudinal axis (X-X). Within the kiln housing (2) a fixedly positioned feed device (5) for the size-reduced plastic waste is placed running in the longitudinal direction of the kiln housing. The feed device (5) at least one-sidedly protrudes with a loading section (6) through a feed opening at an end side of the kiln housing (2), which loading section (6) can be connected to a material feed device (7). At the end side situated opposite the feed opening a gas suction opening (20) is situated in the kiln housing (2). The feed device comprises a conveyor device (5) and a conveyor tube (8), extending along the full length of the kiln housing (2), in which the conveyor device (5) for the size-reduced plastic waste is arranged in such a way that the plastic waste is moved from the loading section (6) in longitudinal direction through the kiln housing (2). The conveyor tube (8) has an outer sleeve (10) configured such that in the interior of the conveyor tube (8) an operational temperature prevails that is below the melting temperature of the size-reduced plastic material. Outlet openings (16, 16*a*, 16*b*, 16*c*, 16*d*, 16*e*) for the size-reduced plastic material are positioned such in the (Continued)

conveyor tube (8) including the sleeve (10) that the size-reduced plastic material drops out of the outlet openings (16, 16*a*, 16*b*, 16*c*, 16*d*, 16*e*) directly onto the opposite interior side of the kiln housing (2).

15 Claims, 1 Drawing Sheet

(52) U.S. Cl.
CPC .... *F23G 2203/20* (2013.01); *F23G 2205/121* (2013.01); *F23G 2205/124* (2013.01); *F23G 2209/28* (2013.01)

(56) References Cited

U.S. PATENT DOCUMENTS 4,730,564 A * 3/1988 Abboud ..... F23G 5/40 432/106
5,908,291 A * 6/1999 Dover ..... F23G 5/20 432/103
2010/0065411 A1* 3/2010 Li ..... C10B 47/32 202/84

* cited by examiner

ROTARY KILN FOR THE EVAPORATION OF THERMOPLASTIC WASTE

This invention relates to a rotary kiln for cracking and evaporating size-reduced plastic waste, consisting of a cylindrical kiln housing the wall of which can be heated to the respective evaporation temperature, and wherein the kiln housing is bearing mounted so as to be rotatable around a longitudinal axis, and wherein within the kiln housing a fixedly positioned feed device for the size-reduced plastic waste is placed running in the longitudinal direction of the kiln housing, wherein the feed device at least one-sidedly protrudes with a loading section through a feed opening at an end side of the kiln housing, which loading section can be connected to a material feed device, wherein at the end side situated opposite the feed opening a gas suction opening is situated in the kiln housing.

Such a rotary kiln is for instance known from DE 10 2014 109 579.0A1 and NL2015089. In these documents, the material to be evaporated is blown into the kiln housing by means of a lance, wherein a directed flow of material is generated towards the interior wall of the kiln housing. This device is suitable for evaporating material particles. From JPH09-279161 a rotary kiln is known in which plastic waste is introduced into the kiln space via an end side of the kiln.

It is an object of this invention to provide a rotary kiln that has improved suitability for melting small flat plates of material, wherein in particular thermoplastic plastic material is used.

According to the invention this is achieved by providing a rotary kiln of the above-mentioned type that is characterized in that the feed device comprises a conveyor device and a conveyor tube, extending along the full length of the kiln housing, in which the conveyor device for the size-reduced plastic waste is arranged in such a way that the plastic waste is moved from the loading section in longitudinal direction through the kiln housing, wherein the conveyor tube has an outer sleeve configured such that in the interior of the conveyor tube an operational temperature prevails that is below the melting temperature of the size-reduced plastic material, and outlet openings for the size-reduced plastic material are positioned such in the conveyor tube including the sleeve that the size-reduced plastic material drops out of the outlet openings directly onto the opposite interior side of the kiln housing. Due to the invention, flat plate-shaped material can be evaporated in the kiln space at a feeding quantity of at least 1500 kg per hour, obtaining an even cover of the heated interior wall of the kiln housing. As the operational temperature in the interior of the conveyor tube is kept below the melting temperature of the particle-shaped plastic material, the plastic particles can be supplied in the kiln space in solid condition and hardly any or no adhesions are formed in the conveyor tube. The kiln temperature is preferably kept at approximately 700° C. (meaning in the range of 690-710° C., preferably from 695-705° C.). The kiln diameter preferably is 0.9-2 m, and the plastic particles preferably consist for 90% of polyolefins (particularly polypropylene and polyethylene), and have a particle size of preferably approximately 10×10 mm having a thickness of approximately 0.2 mm. A kiln with a diameter of 0.9 m has a heated surface of 12 $m^2$. Another temperature of the kiln space and kiln wall can be selected in case of plastic particles of another composition.

Due to the configuration of the outlet openings and the thermal insulation of the conveyor tube, it is ensured that a clogging of the outlet openings is avoided, so that large maintenance intervals are possible. For that purpose, the outlet openings preferably are arranged one behind the other in longitudinal direction, wherein the size of the outlet openings increases such in conveyance direction that there is a substantially unchanged outlet quantity per outlet opening.

The outlet openings may have an identical shape or a shape that differs one from the other, and in particular have a rectangular, circular, or oval shape.

In particular the last outlet opening in conveyance direction has a distance to the kiln housing end side corresponding to 10% to 20% of the overall interior length of the kiln housing. This ensures that even at the end side of the kiln, plastic particles are supplied to the kiln space, which particles will then have a comparatively short dwell time in the kiln, making the formation of high-molecular hydrocarbons such as paraffin possible. Plastic particles that are supplied to the kiln early have a relatively longer dwell time in there, and will therefore be converted into relatively low-molecular hydrocarbons.

Moreover, by controlling the temperature of the walls of the kiln housing the combustion or evaporation product in question can be controlled, wherein the higher the evaporation temperature, the more low-molecular hydrocarbons such as gases are formed, and the lower the combustion or evaporation temperature, the more high-molecular hydrocarbons such as paraffin are obtained.

The conveyor device preferably comprises a conveyor device with a chain or a conveyor device with a screw. Particularly a conveyor device with a chain proved to be advantageous as in that way the portioning of the supply of the particles can be obtained in a highly controlled manner. For that purpose, the conveyor device comprises dish elements that are placed at the chain at regular distances from one another and extend radially relative to the chain, wherein the dish elements preferably have a diameter that substantially corresponds to the interior diameter of the conveyor tube. This means that the dish elements are dimensioned such that they connect to the wall of the conveyor tube with a minimum tolerance. In that way the chain between the dishes each time defines a conveyance chamber in the conveyor tube in which a load of particle-shaped plastic material is situated which at movement of the chain is discharged in the kiln through the openings of the conveyor tube. The conveyor tube preferably has an interior diameter of 15-25 cm, and the dishes are dimensioned correspondingly. The distance between the dishes may vary and even depend on the positioning and dimensions of the outlet openings through which the plastic particles are discharged to the kiln. A distance of 1-3 times the diameter of the dishes proved to be effective.

In an advantageous embodiment, the outlet openings of the conveyor tube, considered in cross-section, become wider from the inside to the outside, shaped like a funnel. As a result, the plastic particles are able to leave the conveyor tube easily as the outlet opening widens in the direction of the kiln space.

The outer sleeve of the conveyor tube preferably consists of a casing of steel enveloping the conveyor tube, wherein between the conveyor tube and the casing an intermediate space is formed that can be filled with coolant and the steel casing is enclosed by a thermal insulation layer, wherein the insulation layer is encircled by a sleeve layer of aluminum, which is surrounded by an outer casing of steel. This build ensures a proper insulation of the conveyor tube in the kiln space and makes effective cooling of the interior of the conveyor tube through which the plastic particles are moved, possible.

Advantageously, the walls of the outlet openings are configured with a protective layer of steel that is connected to the conveyor tube and via a thermal insulation is connected to the outer casing.

In an advantageous embodiment, in the area of the loading section a material inlet is placed above the conveyor device for in that way make supply of particle-shaped plastic material possible.

Outside the kiln housing, the conveyor tube preferably is configured pressure-proof to such an extent that it can be filled with a gaseous medium at an overpressure. This makes the pressurized delivery of the plastic particles from the conveyor tube possible, as a result of which the delivery in the kiln space can be carried out more efficiently.

Preferably, the conveyor device is configured as endless chain. Outside the kiln housing, the endless chain runs annular, and a washing device and/or a cooling station for washing and/or cooling down the chain are placed behind the kiln housing.

Advantageous embodiments of the invention are stated in the dependent claims. The invention will be elucidated on the basis of the exemplary embodiment shown in the drawing, in which:

In the various figures of the drawing the same parts are each time provided with the same reference numbers.

In relation to the description below, it is noted that the invention is not limited to the exemplary embodiments and in addition not to all or various characteristics of the combination of characteristics described; by contrast, each individual characteristic of the or each exemplary embodiment is of importance to the subject matter of the invention, also apart from all other partial characteristics described per se in connection thereto and also in combination with any characteristics of another exemplary embodiment.

Figure 1:
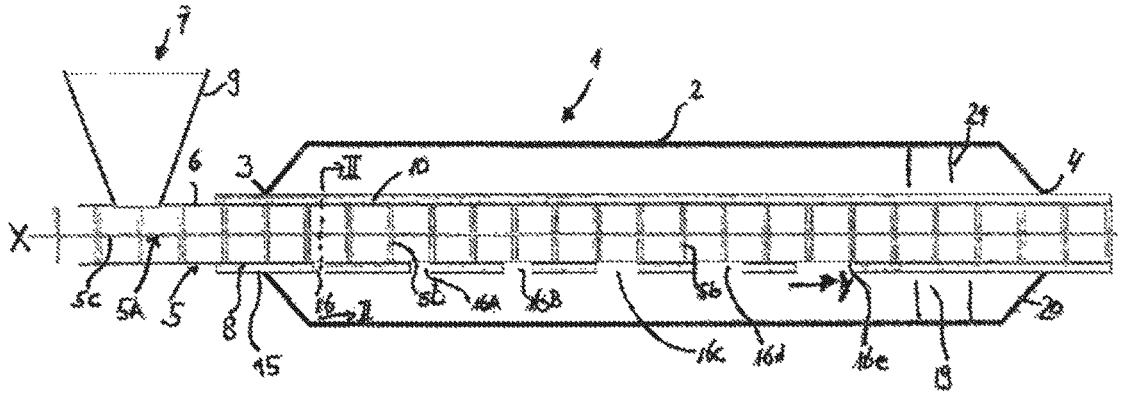
FIG. 1 shows a longitudinal section of the rotary kiln according to the invention.

FIG. 1 shows a rotary kiln 1 according to the invention, which at least comprises a kiln housing 2 to be indirectly heated, which is bearing mounted so as to be rotatable around a kiln longitudinal axis X-X. The kiln housing 2 is configured as hollow cylinder and at both its end sides is closed off by means of a kiln lid 3, 4. By means of a heating device that preferably is located outside the kiln housing, the kiln housing is heated to a temperature to crack plastic waste particles open by evaporation, which particles are situated on the interior side of the heated kiln housing. A conveyor device 5 extending in the longitudinal direction of the kiln housing 2 is situated within the kiln housing, wherein the size-reduced plastic particles made of plastic waste are taken to the cylindrical kiln housing by means of this conveyor device 5. This conveyor device 5 runs through the center of the end side that is closed off by the lid 3, through a feed opening of the end side in longitudinal direction into the kiln housing 2, wherein a loading section 6 protrudes from the kiln housing, which can be connected to a material feed device 7. Plastic waste particles are synthetic thermoplastic material in the form of small plastic platelets e.g. obtained by size reduction from material provided in bales and size-reduced, for instance using a blade shredder.

The feed device or conveyor device 5 comprises a conveyor tube 8, which is passed in longitudinal direction through the center of the kiln housing 2. At least at one side, the conveyor tube 8 protrudes from the kiln housing 2 and runs to below a material feed 7 of the material feed device 7. Preferably at both sides the conveyor device runs out of the kiln housing 2 at the location of its end sides, and the sections running to the outside out of the kiln housing 2 from the lids 3, 4 are for instance connected to each other, so that an endless conveyor device is formed.

The section situated in conveyance direction y and running to the outside near lid 4, may alternatively also serve as overflow at which location superfluous material is carried off.

The conveyor tube 8 effectively is made of steel, in particular of stainless steel and in particular has an interior diameter of 15 to 20 cm. In particular, the conveyor tube 8 is enveloped by a thermally insulating outer sleeve 10 at least in the interior space of the kiln housing 2, which outer sleeve is provided with a steel casing 11, wherein the steel casing 11 is placed at a distance from the conveyor tube 8, so that between both parts a distance and thus an intermediate space is present. In this intermediate space 12 a coolant, for instance water, can be introduced so that this coolant can be pumped from the one outer end of the conveyor tube 8 to the other outer end. Effectively, demineralized water is used. In particular the steel casing 11 is enveloped by an insulation layer 13. Effectively, the insulation layer 13 consists of a mineral material, for instance rock wool. Further, it will be advantageous when the insulation layer 13 is enveloped by a sleeve layer 14 of aluminum film. Due to its low emission capacity, said sleeve layer 14 ensures a reduced IR radiation. The sleeve layer 14 is enclosed by a casing 15 that in particular is made of steel. Said casing 15 is exposed to the temperature prevailing in the interior space of the kiln housing 2.

Effectively, the wall of the kiln housing has a wall temperature of 600° C. to 700° C. The interior diameter of the cylindrical kiln housing 2 is for instance 70 cm to 100 cm. The number of revolutions of the kiln housing 2, with which the kiln housing 2 rotates around the fixedly positioned conveyor device 5, is for instance 10 to 20 revolutions per minute. The outer diameter of the conveyor device 5, including the outer sleeve 10, preferably is 30 cm. Outlet openings 16, 16*a*, 16*b*, 16*c*, 16*d* and 16*e* that sit one after the other in longitudinal direction, are formed in the conveyor tube 8 and in the outer sleeve 10. Said outlet openings 16, 16*a*, 16*b*, 16*c*, 16*d* and 16*e*, differ in size, wherein the size of these outlet openings 16, 16*a*, 16*b*, 16*c*, 16*d* and 16*e* increases in conveyance direction y of the conveyor device. The outlet openings 16, 16*a*, 16*b*, 16*c*, 16*d* and 16*e* may have the same or distinctive shapes compared to each other, and in particular have a rectangular, circular, or oval shape. In terms of size, the outlet openings 16, 16*a*, 16*b*, 16*c*, 16*d* and 16*e* advantageously are placed offset relative to each other at the interior circumference of the conveyor tube 8.

The conveyor device 5 is situated in the interior space 8*a* of the conveyor tube 8, which conveyor device in particular is configured as conveyor device with a chain 5*a*. Alternatively, said conveyor device 5 may also be configured as conveyor device with a screw, see FIG. 3. The speed of the conveyor device with a chain 5*a* is at 1 m/min to 20 m/min, in particular at 18 m/min.

By means of overpressure, for instance of an inert gas or natural gas, the material to be conveyed in the form of small plates of material from the material inlet 9 is introduced in the conveyor tube 8 and placed on the conveyor device 5. The quantity introduced via the material feed 8 is for instance 350 g per second. The conveyor device with a chain 5*a* in this case is an endless chain that for instance runs on an annular track in the conveyor tube 8, so that the conveyor tube 8 itself also sits on an annular track. In that case, the conveyor device with a chain 5*a*, after passing through the rotary kiln 1, for instance also passes through a cleaning station and a cooling station. The conveyor device with a chain 5*a* has dishes 5*b* that are running at a distance from each other, in particular perpendicular to the conveyance direction y, wherein the distance for instance is 20 cm. Said dishes 5*b* are adapted to the cross-section of the interior space of the conveyor tube 8. The dishes 5*b* prevent gases from entering back into the interior space of the conveyor tube 8. The dishes 5*b* are each connected to a chain 5*c* of the conveyor device with a chain 5*a*. The dishes 5*b* for instance have a diameter of 15 cm, just like the interior diameter of the conveyor tube 8.

In cross-section, the outlet openings 16, 16*a*, 16*b*, 16*c*, 16*d* and 16*e* are configured funnel-shaped in cross-section, widening to the outside. At their interior walls, the outlet openings 16, 16*a*, 16*b*, 16*c*, 16*d* and 16*e* are coated with a protective layer, in particular of steel. At one end side, said protective layer 17 is connected to the conveyor tube 8. At the other end side at the transition between this protective layer 17 and the outer casing 15, a thermal insulation 18 is formed, connecting the outer casing 15 to the protective layer 17. Said thermal insulation 18 prevents the temperature of the outer casing 15 from being conducted onward to the conveyor tube 8. Said thermal insulation may for instance consist of a ceramic material.

In particular outlet opening 16*e* that is the last in conveyance direction y, has a distance to the opposite end side of the kiln housing 2 that in particular corresponds to 10% to 20% of the overall interior length of the kiln housing 2. The length of the rotary kiln 1 according to the invention for instance is 7 m. With such an oven length, the outlet opening 16*e* that is the last in longitudinal direction, is for instance placed 1 m before the end side of the kiln housing 2. Between the last outlet opening 16*e* and the end side of the kiln housing 2 a post-treatment section 19 is present, in which for instance a meandering duct is formed because in the area before a suction opening at the end side of the kiln housing 2, two transverse walls 21 are placed at a distance from each other.

The kiln housing 2 is bearing mounted so as to be rotatable around the fixedly positioned conveyor tube 8, and the movement gap between both parts is sealed off such that the medium present in the interior space of the kiln cannot escape.

Due to the outlet openings 16, 16*a*, 16*b*, 16*c*, 16*d* and 16*e* that differ in size from each other, wherein the size of the outlet openings 16, 16*a*, 16*b*, 16*c*, 16*d* and 16*e* increases in the direction towards the side end of the kiln housing, it is effected that an unchanged outlet quantity is obtained along the length of the conveyor tube 8. In that way the overall length of the kiln housing 2 in the area of the outlet openings 16, 16*a*, 16*b*, 16*c*, 16*d* and 16*e* is evenly covered by the small plates dropping onto the interior wall of the kiln so that an even evaporation thereof is effected. The size of the small plates according to the invention is such that a surface area dimension, calculated on the basis of a maximum diameter of 1 cm, give or take 10%, is realized. The thickness of the small plates in particular is 100 p, give or take 10%.

According to the invention, the outlet quantity of the small plates and the number of revolutions of the kiln housing 2 effect that in particular a surface area of 10Δ10 cm of the interior wall of the kiln housing 2 is covered, wherein the overall weight of the small plates in particular is 1 g. The reaction time of the plates on the heated interior wall of the kiln housing 2 in particular is 1 second.

In particular the conveyor tube 8 outside the kiln housing 2 is configured pressure-proof to such an extent that it can be filled with a gaseous medium at an overpressure. Said pressure medium enhances the discharge of the small plates from the outlet openings 16, 16*a*, 16*b*, 16*c*, 16*d* and 16*e*.

The temperature prevailing in the conveyor tube is set such, and is ensured by the thermal insulation, that the temperature prevailing in the interior space cannot lead to the small plates consisting of plastic and being conveyed by the conveyor device 5, being plasticized. According to the invention small plates of a thermoplastic are processed in particular, wherein the temperature in the conveyor tube 8 is below 90° C. In particular, the temperature should clearly be below 90° C., for instance at 50° C. The small plates for instance consist of polyethylene or polypropylene.

Figure 2:
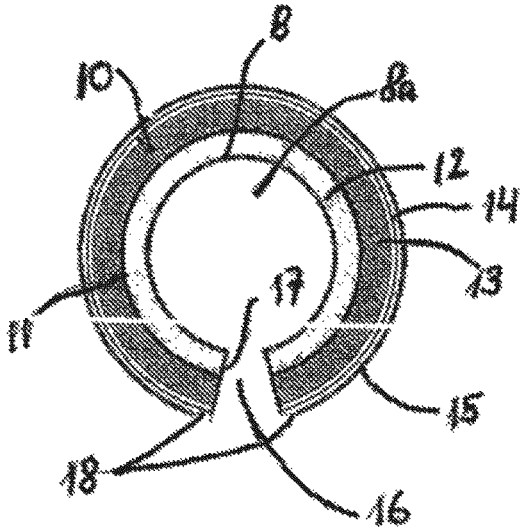
FIG. 2 shows a cross-section at the intersecting line II-II in FIG. 1 of a conveyor tube according to the invention without conveyor device.
Figure 3:
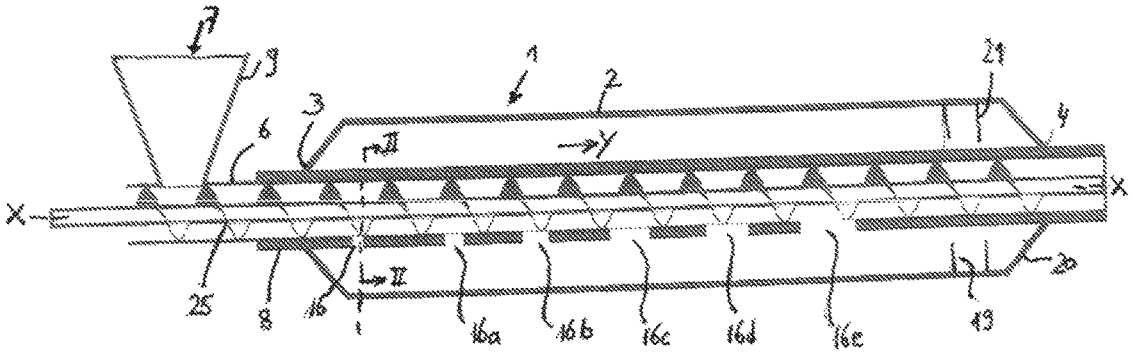
FIG. 3 shows a longitudinal section of an alternative embodiment of a rotary kiln according to the invention.

As indicated in FIG. 3, according to the invention a conveyor device with a screw 25 can also be used as conveyor device 5, which screw comprising conveyor device is driven via a drive unit that is not shown. The conveyor device with a screw 25 starts below the material inlet 9 and ends at the section of the conveyor tube 8 which, situated in conveyance direction y, exits out of the lid 4. As regards the embodiment of the other characteristics and embodiments of rotary kiln 1, it corresponds to the rotary kiln 1 described above in relation to FIGS. 1 and 2.

For operating the rotary kiln 1 according to the invention, first material from a bale of thermoplastic waste is size-reduced into small plates by means of a shredder, in particular a blade shredder, wherein the small plates, on the basis of a diameter of no more than 1 cm, give or take 10%, have a corresponding surface area dimension and a thickness of 100 μm, give or take 10%. The small plates of material have been degassed to a large extent, as the bales of material were compressed prior to shredding. In the rotary kiln 1 according to the invention, the small plates are heated and evaporated to such an extent by the thermal treatment that depending on the temperature, various fuel types, for instance gas, liquid gas, paraffin, or engine fuel can be formed. During conveyance using a conveyor device 5 in the kiln housing 2, the small plates are conveyed in the longitudinal direction of the kiln housing 2 at an own temperature that is below their plasticizing temperature, in particular of 50° C. and, dropping onto the opposite interior surface of the evenly rotating kiln housing 2, they are arranged so as to be evenly distributed over the surface, wherein the surface temperature of the interior wall of the kiln housing 2 advantageously is 600° C. to 700° C. as a result of which the small plates are evaporated. The gas formed by the evaporation of the small plates is sucked out of the interior space of the rotary kiln 1 via suction opening 20 and can be subjected to a subsequent post-treatment, in particular a thermal post-treatment. The ash formed is conveyed out of the kiln as a waste product via a screw device and cooled down.

The rotary kiln 1 according to the invention is capable of evaporating feed quantities of at least 1500 kg per hour.

Effectively, the conveyor tube 8 is configured pressure-proof outside the kiln housing 2.

The rotary kilns according to the invention shown in FIGS. 1-3 are placed horizontally, which is essential to the operation according to the invention.

The invention is not limited to the exemplary embodiments shown and described, but also encompasses all embodiments which, in the spirit of the invention, operate the same. It is emphasized here that the exemplary embodiments are not limited to all characteristics in combination with each other, but that contrary thereto each individual partial characteristic can also have an inventive meaning per se apart from all other partial characteristics. Further, the invention is not limited either to the combination of characteristics defined in claim 1, but may also be defined by any other combination of specific characteristics of all disclosed characteristics. This means that in principle practically every single characteristic of claim 1 can be left out or replaced by at least any other single characteristic described elsewhere in the application.

LIST OF REFERENCE NUMBERS

1 Rotary kiln
2 Kiln housing
3,4 Kiln lids
5 Conveyor device
5*a* Conveyor device with a chain
5*b* Dish
5*c* Conveyor device with a chain
6 Loading section
7 Material feed
8 Conveyor tube
8*a* Interior space of 8
9 Material inlet
10 Outer sleeve
11 Steel casing
12 Intermediate space
13 Thermal insulation layer
14 Sleeve layer
15 Casing
16, 16*a-e* Outlet openings
17 Protective layer
18 Thermal insulation
Post-treatment section

The invention claimed is:

1. Rotary kiln for cracking and evaporating size-reduced plastic waste, consisting of a cylindrical kiln housing the wall of which can be heated to the respective evaporation temperature, and wherein the kiln housing is bearing mounted so as to be rotatable around a longitudinal axis, and wherein within the kiln housing a fixedly positioned feed device for the size-reduced plastic waste is placed running in the longitudinal direction of the kiln housing, wherein the feed device at least one-sidedly protrudes with a loading section through a feed opening at an end side of the kiln housing, which loading section can be connected to a material feed device, wherein at the end side situated opposite the feed opening a gas suction opening is situated in the kiln housing, characterized in that the feed device comprises a conveyor device and a conveyor tube, extending along the full length of the kiln housing, in which the conveyor device for the size-reduced plastic waste is arranged in such a way that the plastic waste is moved from the loading section in longitudinal direction through the kiln housing, wherein the conveyor tube has an outer sleeve configured such that in the interior of the conveyor tube an operational temperature prevails that is below the melting temperature of the size-reduced plastic material, and outlet openings for the size-reduced plastic material are positioned such in the conveyor tube including the sleeve that the size-reduced plastic material drops out of the outlet openings, directly onto the opposite interior side of the kiln housing.

2. Rotary kiln according to claim 1, characterized in that the outlet openings, are arranged one behind the other in longitudinal direction, wherein the size of the outlet openings in conveyance direction increases such that there is an unchanged outlet quantity per outlet opening.

3. Rotary kiln according to claim 2, characterized in that the outlet openings have an identical shape or a shape that differs one from the other, and in particular have a rectangular, circular, or oval shape.

4. Rotary kiln according to claim 1, characterized in that the last outlet opening in conveyance direction has a distance to the kiln housing end side corresponding to 10% to 20% of the overall interior length of the kiln housing.

5. Rotary kiln according to claim 1, characterized in that the conveyor device comprises a conveyor device with a chain or a conveyor device with a screw.

6. Rotary kiln according to claim 5, characterized in that the conveyor device comprises the chain to which dish elements that extend radially relative to the chain are attached at regular distances from one another.

7. Rotary kiln according to claim 6, characterized in that the dish elements have a diameter that substantially corresponds to the interior diameter of the conveyor tube.

8. Rotary kiln according to claim 1, characterized in that the outlet openings considered in cross-section become wider from the inside to the outside, shaped like a funnel.

9. Rotary kiln according to claim 1, characterized in that the outer sleeve consists of a casing of steel enveloping the conveyor tube, wherein between the conveyor tube and the casing an intermediate space is formed that can be filled with coolant and the steel casing is enclosed by a thermal insulation layer, wherein the insulation layer is encircled by a sleeve layer of aluminum, which is surrounded by an outer casing of steel.

10. Rotary kiln according to claim 1, characterized in that the walls of the outlet openings are configured with a protective layer of steel, that is connected to the conveyor tube and via a thermal insulation is connected to the outer casing.

11. Rotary kiln according to claim 1, characterized in that in the area of the loading section a material inlet is placed above the conveyor device.

12. Rotary kiln according to claim 1, characterized in that the conveyor tube outside the kiln housing is configured pressure proof to such an extent that it can be filled with a gaseous medium at an overpressure.

13. Rotary kiln according to claim 1, characterized in that the conveyor device is configured as endless chain.

14. Rotary kiln according to claim 13, characterized in that outside the kiln housing the chain runs annular.

15. Rotary kiln according to claim 14, characterized in that a washing device and/or a cooling station for washing and/or cooling down the chain are placed behind the kiln housing.

* * * * *